US006531939B1

(12) United States Patent
Hanke et al.

(10) Patent No.: US 6,531,939 B1
(45) Date of Patent: Mar. 11, 2003

(54) ELECTROMAGNETIC RELAY

(75) Inventors: Martin Hanke, Berlin (DE); Ralf Hoffmann, Berlin (DE)

(73) Assignee: Tyco Electronics Logistics AG, Steinach (CH)

( * ) Notice: Subject to any disclaimer, the term of this patent is extended or adjusted under 35 U.S.C. 154(b) by 0 days.

(21) Appl. No.: 09/958,185

(22) PCT Filed: Apr. 7, 2000

(86) PCT No.: PCT/IB00/00424

§ 371 (c)(1),
(2), (4) Date: Jun. 16, 2002

(87) PCT Pub. No.: WO00/60625

PCT Pub. Date: Oct. 12, 2000

(30) Foreign Application Priority Data

Apr. 7, 1999 (DE) ..... 199 15 691

(51) Int. Cl.[7] ..... H01H 51/22
(52) U.S. Cl. ..... 335/83; 335/128
(58) Field of Search ..... 335/78–86, 124, 335/128

(56) References Cited

U.S. PATENT DOCUMENTS

| | | | | |
|---|---|---|---|---|
| 3,742,405 A | | 6/1973 | Hayden et al. | 335/187 |
| 4,003,011 A | * | 1/1977 | Hayden | 335/196 |
| 4,064,470 A | * | 12/1977 | Hayden | 335/196 |
| 4,564,828 A | * | 1/1986 | Lowe | 335/276 |
| 5,155,458 A | * | 10/1992 | Gamble | 335/128 |

FOREIGN PATENT DOCUMENTS

| | | | |
|---|---|---|---|
| CA | 978577 | 11/1975 | |
| DE | 36 40 737 A1 | 6/1988 | H01H/50/26 |
| GB | 1 554 423 | 10/1979 | H01H/1/36 |

* cited by examiner

*Primary Examiner*—Lincoln Donovan

(57) ABSTRACT

The relay comprises a base body (27), a coil (1), a core arrangement (3), an armature (10) and a contact system. The contact spring (16) is configured as an arc and arranged to be connected with the armature (10) in such a way that it is subjected to uniform, low mechanical loading. As a result a material can be used for the contact spring (16) which presents high electrical conductivity, so that the forward resistance of the relay is reduced. The contact spring (16) and armature (10) are arranged in such a way that a relay with a compact structure can be obtained.

17 Claims, 3 Drawing Sheets

ELECTROMAGNETIC RELAY

FIELD OF THE INVENTION

The present invention relates to a universally applicable electromagnetic relay.

BACKGROUND OF THE INVENTION

A relay contact spring must generally accomplish two tasks. On the one hand it supports a switch contact, which is pressed against a fixed contact via the spring force of the contact spring, on the other hand it is via said contact spring that the current is conducted to the switch contact. Whereas in the first case mechanical loading ability is of significance, the second task requires high electrical conductivity. Materials which exhibit high flexural strength in order to resist high mechanical loading, however, exhibit low conductivity and vice versa. If the relay is to generate large currents, the forward resistance is generally too great due to the poor conductivity of the contact spring and an additional flex must be provided to conduct the current to the movable contact.

A simpler method to reduce forward resistance of a relay is either to design the spring as particularly wide or to use a material exhibiting good conductivity. The latter variation, however, requires the mechanical loading of the spring to be relatively minor. The spring can be arched to this effect in order to uniformly distribute the ensuing bending stress.

A relay comprising an arched leaf spring is already known from DE 36 40 737 C2. Said spring is fixed at one end to a magnet yoke and at the other end to a plane side of the armature. A projection of said leaf spring supports a switch contact. Mechanical loading of the spring material is significantly higher in the region close to the fastenings than it is in the middle of the spring. Consequently, an arched shape of this type is suitable only in as far as it enables, through low mechanical loading of the spring material, the use of a material with high electrical conductivity.

SUMMARY OF THE INVENTION

It is the aim of the present invention to provide an electromagnetic relay with a low forward resistance without the need for additional components or an increase in structure size.

According to the invention, this aim is realised by a relay featuring the following characteristics:

- a base body,
- a coil,
- a core arrangement,
- an armature, which at one armature end is pivotally arranged around an armature rotational axis to an end section of the core arrangement and the other end of which forms a free armature end,
- at least one fixed contact,
- a contact spring, which is attached at one fastening end to an immovable section of the relay, comprising a movable contact spring end, which is coupled to the free armature end, and comprising at least one switch contact, which cooperates with at least one of the fixed contacts, whereby the contact spring is generally overall arched and designed as a momentum spring and whereby the switch contact is arranged at a middle section of the contact spring.

The relay according to the invention is advantageous due to the mechanical loading of the contact spring being very low and uniform. This is achieved primarily through designing the contact spring as a momentum spring. A momentum spring can be defined in that both spring ends are attached to third parts in such a way that no rotation of the spring end takes place to each third part around the fastening point.

Due to the movement of the free armature end, a torque is applied to the contact spring. Both spring ends are fastened in a torque-resistant manner.

The contact spring has the characteristic feature that the deformation of the spring during movement occurs in such a way that bending modification is almost constant. On this basis, the bending loads of the contact spring are, to a large extent, constant along the spring. The mechanical loadings of the spring are also low due to the large length of the contact spring. This is the case when the free contact spring end is fastened to the free armature end.

The low loading in the region of the contact spring ends is ensured in an advantageous manner in that the fastening plane of the movable contact spring end lies tangential to the moving direction of the free armature end, since as a result the spring is merely incidentally bent at the fastening point. There is equally an advantage when the fastening plane of the fastening end is essentially perpendicular to a very short connecting line extending from a fastening edge, on which the movable part of the contact spring commences, to the armature rotational axis.

The forward resistance is furthermore reduced, if the switch contact is arranged in a middle region of the contact spring, since as a result the current path is shortened from a linking connector to the switch contact. This arrangement has the additional advantage that a path transformation occurs from the free armature end to the switch contact and the contact opening forces of the switch contact are increased in comparison to an arrangement close to or beyond the armature end. In combination with an armature comprising a particularly large opening angle and thus covering a large path when closing, a weaker design of the magnet system is possible, at the same supporting a compact structure. As a result, an even weaker material can in addition be used for the contact spring, since the required restoring force is lower.

A particularly advantageous embodiment describes the contact spring in the form of an elliptical section, as in this embodiment the loading is distributed particularly uniformly over the length of the contact spring.

A further advantage follows from the armature rotational axis being positioned in approximately the middle of the region described by the contact spring, since as a result the free armature end is guided on a circular path, which subjects the contact spring to a particularly gentle stress, as a homogenous loading distribution ensues for the contact spring. The following applies for a substantially arched spring: if the form of the spring approaches that of an arc, the arc's central point would correspond to the rotational axis.

An additional advantage of the invention follows from the contact spring being simultaneously able to bias the armature into a resting position, thus dispensing with an armature restoring spring.

The production of a contact spring for a relay according to the invention is particularly straightforward if the contact spring exhibits a constant width over its entire length and if for instance boreholes can be allotted at particular points for alleviating the load of the contact spring.

The contact spring is preferably made out of a highly electrically conductive material, the mechanical characteristics of which are nevertheless sufficient on the basis of the uniformly low mechanical loadings.

Further details of the embodiments of the invention are described in the subclaims.

BRIEF DESCRIPTION OF THE DRAWINGS

The invention is described in more detail in the form of an embodiment shown in the drawings. In the drawings.

DETAILED DESCRIPTION OF THE PREFERRED EMBODIMENT

Figure 1:
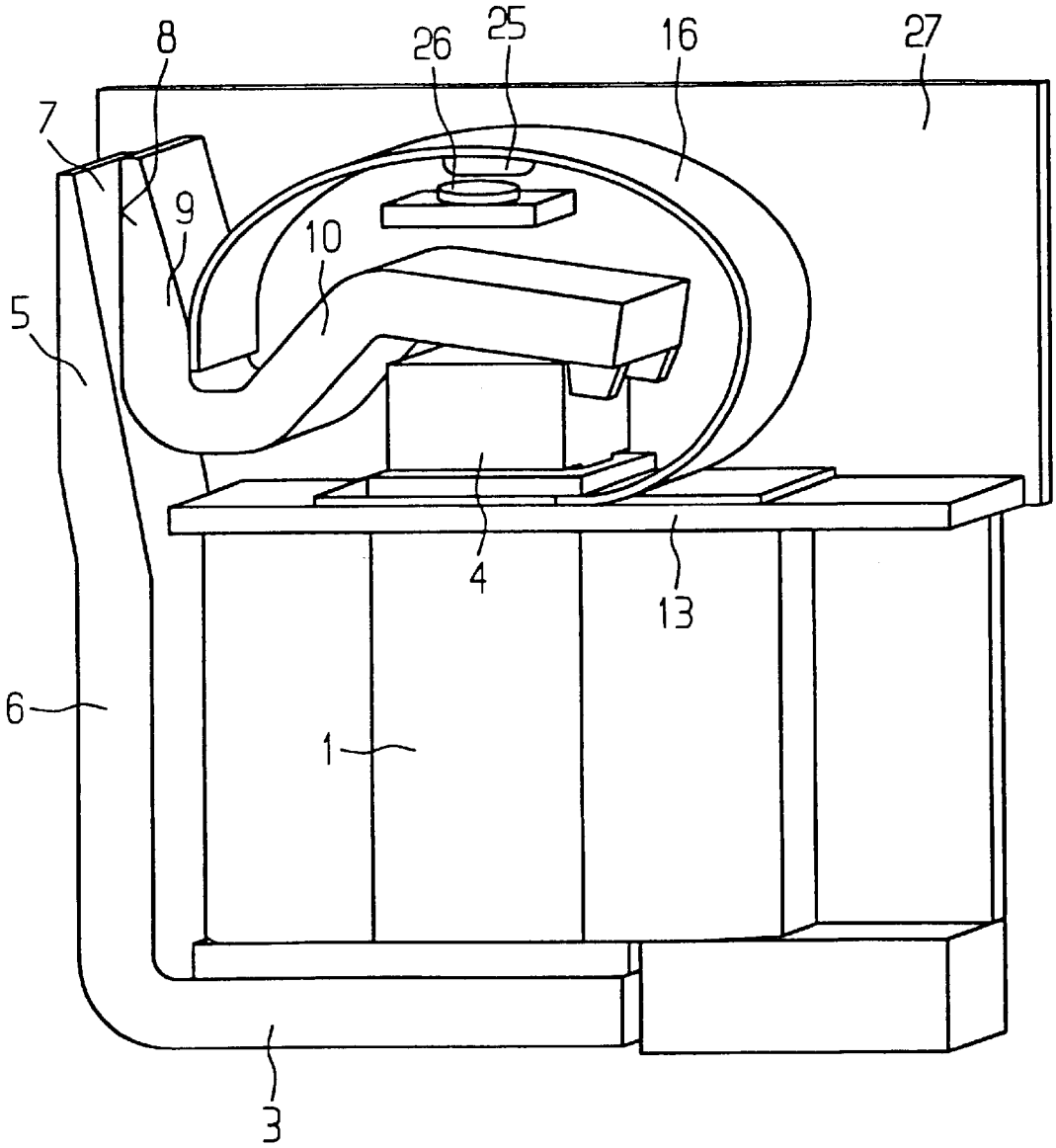
FIG. 1 represents a relay according to the invention, with the contact spring also acting as a restoring spring.
Figure 2:
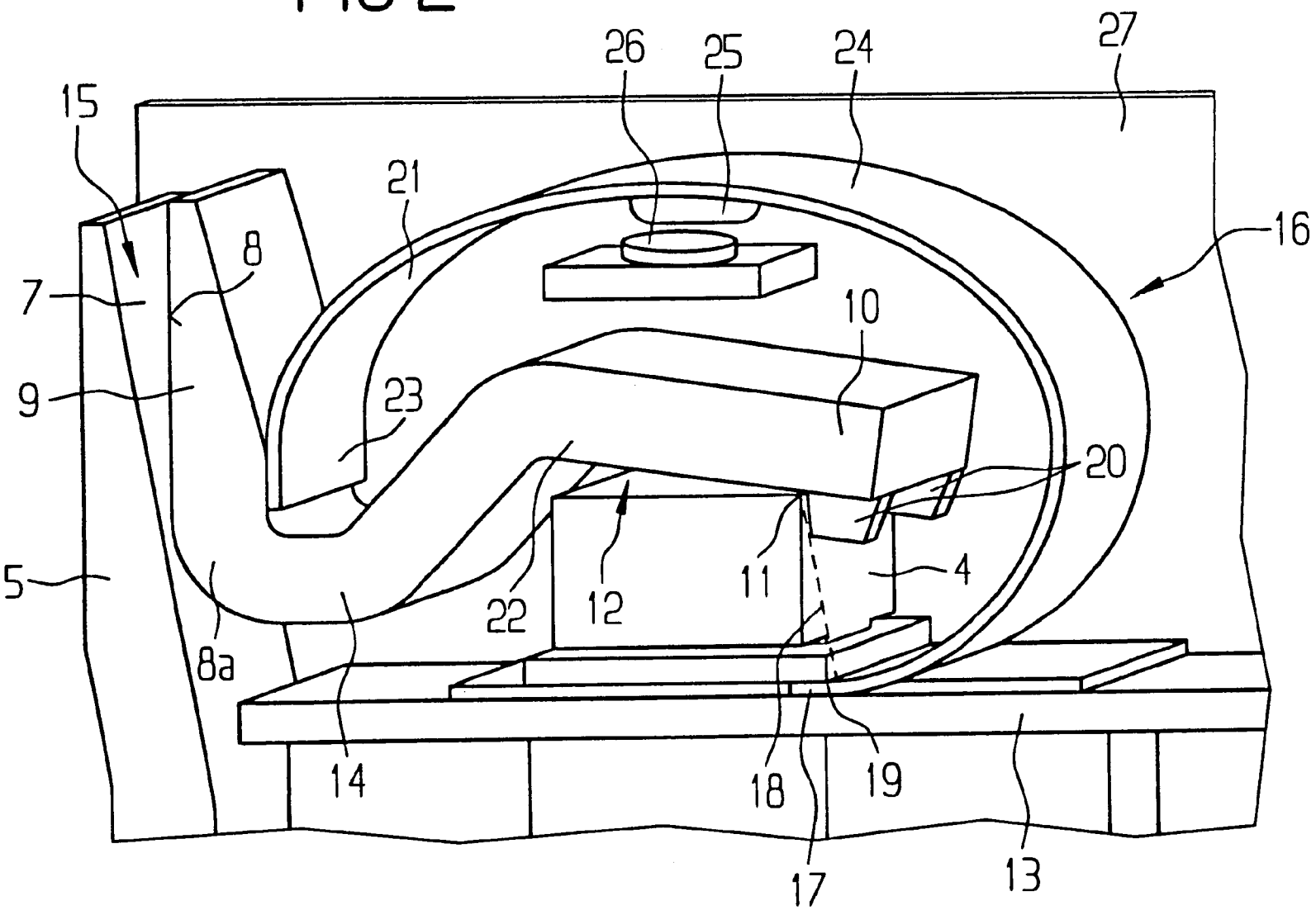
FIG. 2 represents a partial view showing the armature and the contact system of the relay of FIG. 1.

In a first embodiment according to FIGS. 1 and 2, a coil 1 is positioned on a first leg of a core arrangement 3, such that an armature bearing section 4 of the first leg, otherwise not visible in the figures, is located outside the coil 1. A pole section 5 of a second leg 6 of the core arrangement 3 forms a core pole face 7, which cooperates with an armature pole face 8 at a free end 9 of an armature 10. On the edge of the armature bearing section 4 opposite the second leg 6, the armature 10 is pivotally mounted with an inside edge around a bearing edge 11, which forms the armature rotational axis, such that in an opened state a wedge-shaped armature bearing gap 12 is formed between the armature 10 and the armature bearing section 8 and disappears in an armature closing position. The inside edge arises from the formation of two projections 20 to the armature 10. The armature 10 is essentially L-shaped and arranged in such a way that the oblique leg of the L, representing the free armature end 9, points outwards. The armature 10 deviates from the L shape to the extent that in a middle section 14 it is bent inwards.

The free armature end 9, with its armature pole face 8 and the core pole face 7, forms a working air gap 15. In the region of its front end 8*a* in the closing direction, the armature pole face 8 is essentially perpendicular to a connecting line extending to the bearing edge 11. When the armature 10 is attracted, the core pole face 7 extends approximately parallel to the armature pole face 8. Due to the integrally formed projections 20 the armature 10 is unable to move, due to the magnet force operating in the working air gap 15, such that the working air gap 15 closes. A contact spring 16 has among others the task of pressing the inside edge of the armature 10 against the bearing edge 11 of the end section 4, so that the armature 10 is capable merely of a rotary movement.

The opening angle of the armature bearing gap 12 of such a magnet system, for instance when 10°, is large in comparison to a conventional flap armature system with an opening angle generally no greater than 5°.

A fastening end 17 of the contact spring 16 is fastened together with a linking connector (not represented) to the armature bearing section 4 at the side on which the bearing edge 11 is also located, close to a coil former flange 13, preferably by injection moulding. In the region of its fastening end 17, the contact spring 16 tangentially approaches a plane which lies parallel to the front face of the armature bearing section 4.

A very short connecting line 18 between a clamping edge 19, on which the fastening end 17 of the contact spring 16 and a movable part 21 of the contact spring 16 are adjacent, and the bearing edge 11, stands approximately perpendicular on the fastening plane of the fastening end 17. This ensures that the loading of the contact spring 16 at the clamping edge 19 is similarly high to other regions of the contact spring 16. There is the possibility, however, that in other embodiments, this criterion is not fulfilled to the same extent, if for instance constructive measures for the sake of saving space result in a different position of the fastening edge.

The movable part 21 of the contact spring 16 is bent around the armature bearing section 4 and a longitudinal leg 22 of the armature 10 and is fastened to the free armature end 9. The movable end 23 of the contact spring 16 follows the free armature end 9 in its movement. In the region of its fastening to the armature 10, the contact spring 16 lies in a plane which runs tangentially to the direction of movement of the free armature end 9. Due to this arrangement, the contact spring 16 adopts the approximate form of an ellipse, whereby approximately a quarter of the ellipse remains open. The fastening of the contact spring to the armature could also ensue through a movable coupling. To optimise the size of the relay, the contact spring 16 can also be designed in such a way that the shape deviates strongly from an ellipse.

Through the arrangement of the contact surface 16, the bearing edge 11 lies approximately in the middle of the ellipse, resulting during the movement of the armature in a "natural" loading of the contact spring 16, which distributes itself uniformly over the entire length of the contact spring 16.

The contact spring 16 comprises a middle section 24, on which a switch contact 25 is fastened. In the embodiment represented in FIGS. 1 and 2, said switch contact cooperates with a fixed contact 26, the position of which is fixed on a base body 27. The switch contact 25 lies on approximately half of the contact spring length, resulting in a short current path to the linking connector (not represented) at the fastening end 17 of the contact spring 16. The opening forces for the opening of the contacts 25 and 26 are particularly large, since force transmission takes place between the free armature end 9 and the switch contact 25. The distance of the contacts 25 and 26 in the opening position is nevertheless sufficient, as the opening angle of the armature bearing gap 12 can be selected to be correspondingly large. On the basis of the advantageous embodiment of the armature 10, there are nevertheless no disadvantages in terms of the efficiency of the magnetic circuit.

During the activation of the coil 1, the armature pole face 8 is attracted to the core pole face 7, and the armature 10 moves into the closing position. When the armature 10 is in the closed position, the movable contact 25 forms a connection with the fixed contact 26.

When the coil 1 is deactivated, the contact spring 16, which in a particularly advantageous arrangement also acts as a restoring spring, moves the armature 10 in the direction of the opened position, as the armature 10 is biased in the opened position during the resting state of the relay. It is also conceivable, however, to put in an additional restoring spring. The opening movement of the armature 10 causes the contacts 25 and 26 to separate, and the current path through the relay is interrupted.

A design of the contact spring according to the invention, according to the embodiment shown in FIGS. 1 and 2, is also advantageous in that for the uniform loading of the spring, the spring width does not need to be altered and no other measures, for instance load-alleviating boreholes, are necessary, as is normally the case. As a result, manufacturing is rendered easier, which also brings about advantages from a cost perspective.

Figure 3:
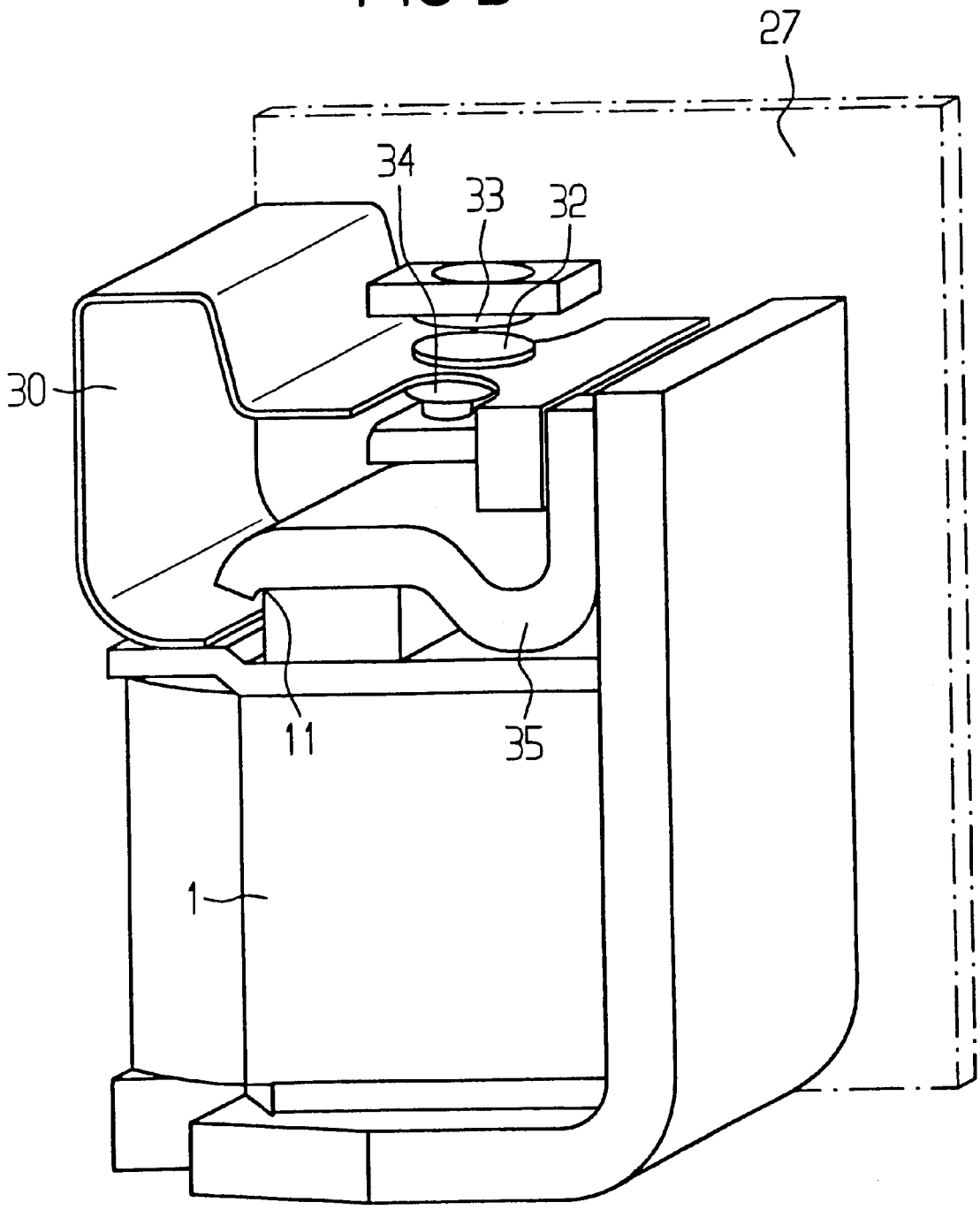
FIG. 3 represents a further embodiment of a relay according to the invention.

In a further embodiment according to FIG. 3, a relay according to the invention is shown in a concrete embodiment. Similarly to the schematic representation of FIGS. 1 and 2, the relay comprises no additional armature restoring spring, instead the armature restoring force, which biases the armature 35 into an opening position, is ensured by the contact spring 30. It is also possible, however, to design the relay with an additional armature restoring spring; the latter can for instance be arranged in the free region between the armature 35 and the contact spring 30.

In the middle region of the contact spring 30 a movable contact 32 is arranged, which, in the opened position of the armature 35, cooperates with a first fixed contact 33, and in the closed armature position with a second fixed contact 34.

The shape of the contact spring 30 deviates from the shape of the contact spring 16 of the first embodiment and through several bending edges of the contact spring 30 ensures a space-saving structure.

In addition to the represented embodiment with a single contact the contacts 32, 33 and 34 can also be designed as double contacts. In this case, however, a longitudinal slot would have to be provided in the contact spring 30 between both switch contacts, to level out the inevitable tolerances at the level of the contacts. With such a design of the contacts, the contact system can also be connected as a bridging (double) change-over. In this case the current supply to the switch contacts would have to occur separately to the spring tensioning.

We claim:

1. An electromagnetic relay comprising:

a base body;

a coil;

a core arrangement;

an armature, which at one armature end is pivotally arranged around a rotational axis to an armature bearing section of the core arrangement and the other end of which forms a free armature end;

at least one fixed contact, and;

a contact spring, which is attached at one fastening end to an immovable section of the relay, comprising a movable contact spring end, which is coupled to the free armature end, and comprising at least one switch contact, which cooperates with at least one of the fixed contacts, whereby the contact spring is generally overall arched and designed as a momentum spring, and whereby the switch contact is arranged at a middle section of the contact spring.

2. The relay according to claim 1, wherein the armature rotational axis is positioned in approximately the middle of the region described by the contact spring.

3. The relay according to claim 1, wherein the fastening plane of the movable contact spring end lies tangential to the direction of movement of the free armature end.

4. The relay according to claim 1, wherein the fastening plane of the fastening end of the contact spring is essentially perpendicular to a very short connecting line extending from a fastening edge, on which the movable part of the contact spring commences, to the armature rotational axis.

5. Relay according to claim 1, wherein the movable contact spring end is movably coupled to the free armature end.

6. The relay according to claim 1, wherein the contact spring simultaneously biases the armature into a resting position.

7. The relay according to claim 1, wherein at the armature in the region of the armature rotational axis at least one projection is formed, which is adjacent to the armature bearing section, whereby a shifting of the armature in the direction of the free armature end is avoided.

8. The relay according to claim 1, wherein the armature rotational axis is fixed through a bearing edge to the armature bearing section of the core arrangement and a thereto adjacent inside edge of the armature.

9. The relay according to claim 8, wherein the contact spring presses the inside edge of the armature against the bearing edge.

10. The relay according to claim 1, wherein the contact spring is made out of a highly electrically conductive material.

11. The relay according to claim 1, wherein an additional restoring spring biases the armature into a resting position.

12. The relay according to claim 1, wherein the contact spring essentially describes an elliptical section.

13. The relay according to claim 1, wherein the contact spring exhibits a uniform width over its length, at least between the fastening end and the switch contact.

14. The relay according to claim 1, wherein an opening angle between the armature and the armature bearing section of the core arrangement lies between 5° and 15°.

15. The relay according to claim 1, wherein the switch contact and the fixed contacts are designed as double contacts.

16. The relay according to claim 15, wherein the contact spring comprises a longitudinal slit in the middle section between both contacts.

17. The relay according to claim 1, wherein the armature pole face, in the region of its front end in the closing direction, is essentially perpendicular to a connecting line to the armature rotational axis and in that when the armature is attracted, the core pole face extends at least approximately parallel to the armature pole face.

* * * * *